US010211012B2

(12) United States Patent
Fukushima et al.

(10) Patent No.: US 10,211,012 B2
(45) Date of Patent: Feb. 19, 2019

(54) CLICK MECHANISM FOR ELECTRIC PART

(71) Applicant: TOKYO COSMOS ELECTRIC CO., LTD., Kanagawa (JP)

(72) Inventors: Hajime Fukushima, Kanagawa (JP); Taro Fukunaga, Kanagawa (JP)

(73) Assignee: TOKYO COSMOS ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 15/810,941

(22) Filed: Nov. 13, 2017

(65) Prior Publication Data

US 2018/0068813 A1 Mar. 8, 2018

Related U.S. Application Data

(63) Continuation of application No. 14/764,762, filed as application No. PCT/JP2013/065893 on Jun. 7, 2013, now Pat. No. 9,911,555.

(51) Int. Cl.
*H01H 19/14* (2006.01)
*H01H 19/11* (2006.01)
(Continued)

(52) U.S. Cl.
CPC ..... *H01H 19/14* (2013.01); *H01H 19/11* (2013.01); *H01H 19/54* (2013.01); *H01H 19/58* (2013.01); *H01H 2221/01* (2013.01)

(58) Field of Classification Search
CPC ..... H01H 19/14; H01H 19/11; H01H 19/54; H01H 2221/01; H01H 19/58
(Continued)

(56) References Cited

U.S. PATENT DOCUMENTS 2,399,906 A 5/1946 Bentley
7,476,822 B2 1/2009 Miura
(Continued)

FOREIGN PATENT DOCUMENTS

CN 1276612 12/2000
CN 101339858 1/2009
(Continued)

OTHER PUBLICATIONS

Office Action issued in European Patent Office (EPO) Counterpart Patent Appl. No. 1388623.6, dated Apr. 17, 2018.
(Continued)

*Primary Examiner* — Edwin A. Leon
*Assistant Examiner* — Lheiren Mae A Caroc
(74) *Attorney, Agent, or Firm* — Greenblum & Bernstein, P.L.C.

(57) ABSTRACT

The click mechanism comprises a spring made of a plate material and disposed on a rotatable plate that rotates integrally with a rotationally-manipulated shaft of an electric part; two cylindrical click pieces disposed on an outer perimeter of the rotatable plate in positions forming an angle of 180° with respect to each other so as to retractably protrude from the positions at different heights on the outer perimeter in an axial direction; and projections and depressions formed on an inner perimeter of a housing in a circumferential direction, in two upper and lower tiers in the axial direction. The projections and depressions in the two upper and lower tiers are staggered and the two click pieces are biased by the spring to be in resilient contact with the projections and depressions.

3 Claims, 9 Drawing Sheets

(51) Int. Cl.
*H01H 19/54* (2006.01)
*H01H 19/58* (2006.01)

(58) Field of Classification Search
USPC ..... 200/564, 565, 568, 569, 336
See application file for complete search history.

(56) References Cited

U.S. PATENT DOCUMENTS

| | | | | |
|---|---|---|---|---|
| 7,902,468 | B2 | 3/2011 | Miyata et al. | |
| 8,552,325 | B2 | 10/2013 | Fukushima | |
| 2008/0173112 | A1 | 7/2008 | Hiroe et al. | |
| 2008/0190752 | A1 | 8/2008 | Miyata et al. | |
| 2012/0000758 | A1* | 1/2012 | Fukushima | H01H 19/11 200/337 |
| 2015/0380185 | A1* | 12/2015 | Fukushima | H01H 19/54 200/336 |

FOREIGN PATENT DOCUMENTS

| | | | |
|---|---|---|---|
| CN | 102334170 | | 1/2012 |
| GB | 1444584 | * | 8/1976 |
| JP | 48-10690 | | 2/1973 |
| JP | 58-98735 | | 7/1983 |
| JP | 2000-348568 | | 12/2000 |
| JP | 2008-198370 | | 8/2008 |
| JP | 2009-289677 | | 12/2009 |
| JP | 2009-295430 | | 12/2009 |
| JP | 4755718 B | | 6/2011 |

OTHER PUBLICATIONS

Office Action issued in Taiwan Counterpart Patent Appl. No. 102120514, dated Mar. 9, 2016 , along with an English translation thereof.

Search Report issued in European Patent Office (EPO) Patent Application No. 13886263.5, dated Oct. 5, 2016.

Office Action issued in China Counterpart Patent Appl. No. 201380074655.7, dated Jun. 8, 2017 , along with an English translation thereof.

Office Action issued in China Counterpart Patent Appl. No. 201380074655.7, dated Dec. 6, 2017 , along with an English translation thereof.

Office Action issued in Republic of Korea Counterpart Patent Appl. No. 10-2015-7024528, dated Sep. 6, 2018, along with an English translation thereof.

Office Action issued in European Patent Office (EPO) family member Patent Appl. No. 13886263.6, dated Dec. 17, 2018.

* cited by examiner

PRIOR ART

CLICK MECHANISM FOR ELECTRIC PART

CROSS-REFERENCE TO RELATED APPLICATIONS

This is a continuation application of pending U.S. patent application Ser. No. 14/764,762, filed on Jul. 30, 2015, which is a U.S. National Stage Application of International Application PCT/JP2013/065893, filed Jun. 7, 2013. The disclosures of these documents, including the specifications, drawings and claims, are incorporated herein by reference in their entirety.

TECHNICAL FIELD

The present invention relates to a click mechanism that produces a click feel (a tactile response) during manipulation of a rotatable electric part.

BACKGROUND ART

FIG. 10 shows an arrangement described in Patent literature 1 as an example of prior art of a click mechanism of this kind. In FIG. 10, reference numeral 1 denotes a bearing that supports a rotationally-manipulated shaft of a switch and reference numeral 2 denotes a rotatable plate.

The bearing 1 has an attachment part 1*a* having an attachment thread formed in the outer perimeter, and a housing part 1*b* formed integrally with the attachment part 1*a* at one end of the attachment part 1*a*. The attachment part 1*a* has a shaft hole in which the rotationally-manipulated shaft is inserted. The housing part 1*b* has a recess formed, into which the shaft hole opens. The inner perimeter of the recess has protrusions and depressions 1*c* formed in the circumferential direction.

The rotatable plate 2 is housed in the housing part 1*b*, and a recess 2*a* is formed on the upper surface of the rotatable plate 2. A U-shaped spring 3 is housed and placed in the recess 2*a*, and short cylindrical click pieces 4 are housed and placed in notches 2*b* formed in the rotatable plate 2 at the sides opposite to the leg parts of the U-shaped spring 3. The two click pieces 4 are biased in the opposite directions by the leg parts of the spring 3, and in resilient contact with the projections and depressions 1*c* formed on the housing part 1*b*.

The rotationally-manipulated shaft is inserted in a shaft hole 2*c* of the rotatable plate 2, so that the rotatable plate 2 rotates integrally with the rotationally-manipulated shaft. At this time, the click pieces 4 move along the protrusions and depressions 1*c* of the housing 1*b*, thereby producing a click feel.

PRIOR ART LITERATURE

Patent Literature

Patent literature 1: Japanese Registered Patent No. 4755718

SUMMARY OF THE INVENTION

Problems to be Solved by the Invention

In the conventional click mechanism shown in FIG. 10, the two click pieces 4 are placed in positions in the rotatable plate 2 forming an angle of 180° with respect to each other, are biased in the opposite directions by the leg parts of the spring 3, and slide on the same line (on the same projections and depressions 1*c*) on the inner perimeter of the housing part 1*b*.

In this case, the projections and depressions 1*c* on which the click pieces 4 slide are point-symmetric with respect to the center of rotation of the rotatable plate 2, and therefore, for example, the number of clicks (production of a click feel) in 360° rotation is always an even number and an odd number of clicks is impossible. It is impossible, for example, to obtain 1 as the number of clicks in 360° rotation. To enable the number of clicks to be an odd number, for example, there is a constraint that an angle of rotation must be less than 180°.

In view of such a problem, an object of the present invention is to provide a click mechanism for an electric part in which an entire region of 360° rotation can be effectively used and the number of clicks can be freely set, unlike prior art in which the number of clicks is limited to an even number.

Means to Solve the Problems

According to claim 1 of the present invention, a click mechanism for an electric part that has a rotationally-manipulated shaft comprises: a spring that is made of a plate material and disposed on a rotatable plate that rotates integrally with the rotationally-manipulated shaft; two cylindrical click pieces disposed on an outer perimeter of the rotatable plate in positions forming an angle of 180° with respect to each other so as to retractably protrude from the positions at different heights on the outer perimeter in an axial direction of the rotationally-manipulated shaft; and projections and depressions formed on an inner perimeter of a housing for the rotatable plate in a circumferential direction, in two upper and lower tiers in the axial direction, in which the projections and depressions in the two upper and lower tiers are staggered in the circumferential direction and the two click pieces are biased by the spring to be in resilient contact with the projections and depressions in the two upper and lower tiers at perimeters thereof.

According to claim 2 of the present invention, in claim 1 of the present invention, the spring has a U shape, and the leg parts of the U-shaped spring bias the two click pieces in the opposite directions.

According to claim 3 of the present invention, in claim 1 of the present invention, the spring has a ring shape with an opening, and the halves on the opposite sides of the opening bias the two click pieces in the opposite directions.

Effects of the Invention

According to the present invention, two click pieces or two protrusions integrally formed with a spring for producing a click feel slide on different projections and depressions, and therefore the number of clicks can be freely set and an entire region of 360° rotation can be effectively used.

DETAILED DESCRIPTION OF THE EMBODIMENTS

An embodiment of the present invention will be described with reference to the drawings.

Figure 1:
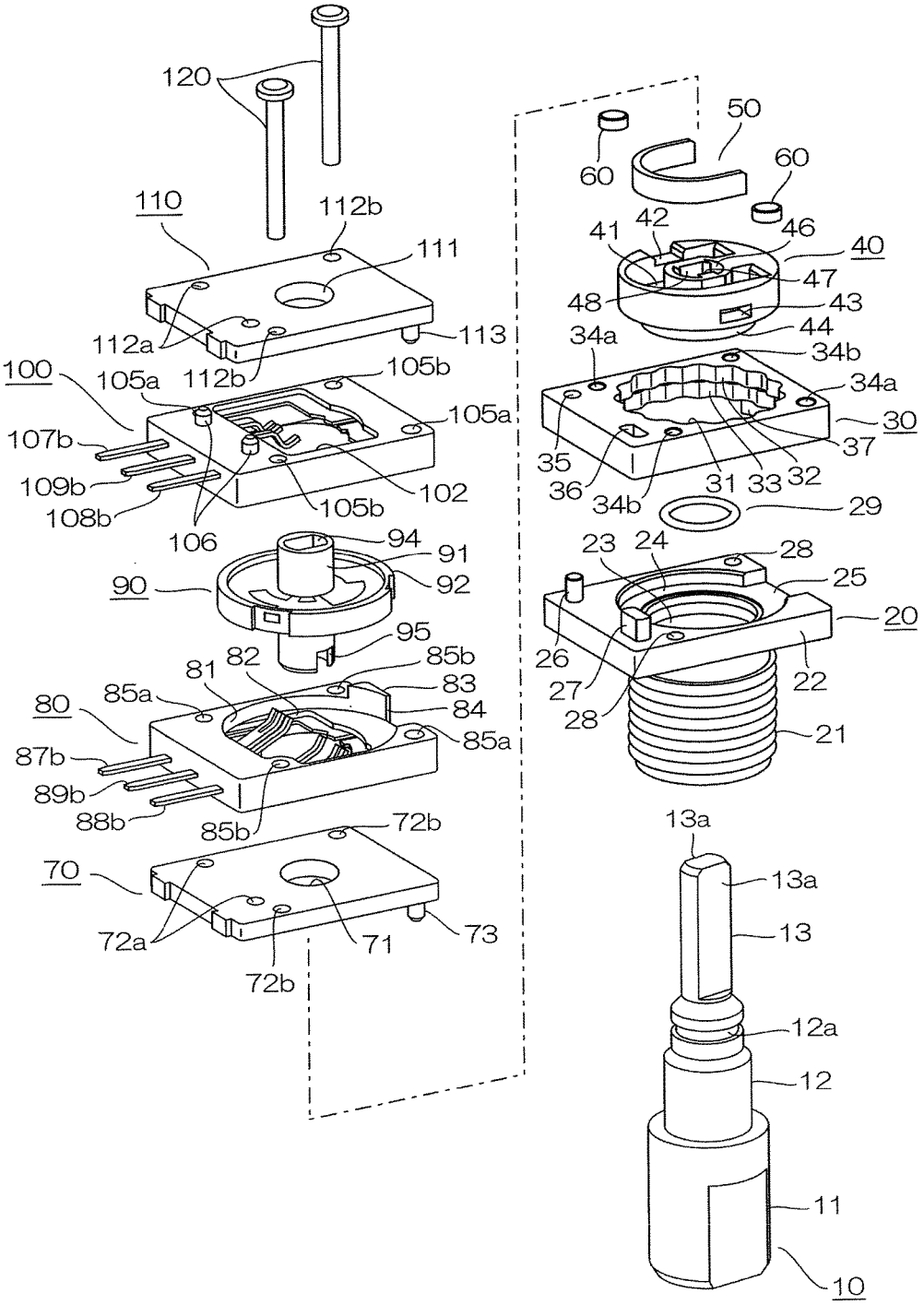
FIG. 1 is an exploded perspective view of a switch provided with a click mechanism according to an embodiment of the present invention.

FIG. 1 shows an arrangement of a rotationally-manipulated switch, which is an example of an electric part provided with a click mechanism according to the present invention. The switch comprises a rotationally-manipulated shaft 10, a bearing 20, a ring 29, a housing 30, a rotatable plate 40, a spring 50, a click piece 60, an intermediate plate 70, a lower contact element holder 80 that holds a contact element, a rotor 90, an upper contact element holder 100 that holds a contact element, a cover 110, and rivets 120.

The rotationally-manipulated shaft 10 has a manipulating part 11, a holding part 12 having a smaller diameter than the manipulating part 11 that coaxially extends from the tip of the manipulating part 11, and a driving part 13 having a smaller diameter than the holding part 12 that coaxially extends from the tip of the holding part 12. An annular groove 12*a* is formed in the outer perimeter of the holding part 12 at a site close to the tip end thereof. The driving part 13 has two parallel flat surfaces 13*a* that are formed by cutting away the driving part 13 in parallel to the central axis thereof. The rotationally-manipulated shaft 10 is made of resin or metal.

The bearing 20 has an attachment part 21 having an attachment thread formed in the outer perimeter, and a rectangular flange 22 formed integrally with the attachment part 21 at one end of the attachment part 21. The attachment part 21 has a shaft hole 23 at the center thereof in which the holding part 12 of the rotationally-manipulated shaft 10 is rotatably inserted. The flange 22 has a circular recess 24 formed coaxially with the shaft hole 23 on the side of the upper surface thereof, and the shaft hole 23 opens into the bottom surface of the recess 24. The flange 22 has an engaging recess 25 formed in a side wall part of the recess 24, which is adjacent to one side of the flange 22. The engaging recess 25 is formed by cutting away a portion of the side wall part. The flange 22 has two positioning protrusions 26 and 27 formed in the upper surface adjacent to a side opposite to the side in which the engaging recess 25 is formed. The positioning protrusion 26 is cylindrical and the positioning protrusion 27 is elliptic cylindrical. Furthermore, the flange 22 has fixing holes 28 formed in the upper surface at a pair of diagonally opposite corners. The bearing 20 is made of resin or metal.

The housing 30 has the same rectangular shape as the flange 22 of the bearing 20 and has an opening 31 formed at the center thereof having the same diameter as the recess 24 of the flange 22. The inner perimeter of the opening 31 has projections and depressions formed in two upper and lower tiers with a predetermined pitch, in an uneven shape in the circumferential direction. Upper-tier projections and depressions 32 and lower-tier projections and depressions 33 are formed so that the projections and depressions are staggered in the circumferential direction. The housing 30 has positioning holes 34*a* formed in the upper surface at a pair of diagonally opposite corners and fixing holes 34*b* formed in the upper surface at the other pair of diagonally opposite corners. Moreover, positioning holes 35 and 36 are formed in positions corresponding to the positioning protrusions 26 and 27 of the bearing 20. Furthermore, an engaging protrusion 37 that is to be fitted in the engaging recess 25 of the bearing 20 is formed in the lower surface. The housing 30 is made of resin or metal.

The rotatable plate 40 has a circular shape and is made of resin or metal. A substantially U-shaped recess 41 is formed in the upper surface of the rotatable plate 40. In addition, a notch 42 that is in communication with the U-shaped recess 41 and extends to the outer perimeter of the rotatable plate 40 is formed at one leg part of the U-shaped recess 41, and a window 43 that is in communication with the U-shaped recess 41 and extends to the outer perimeter of the rotatable plate 40 is formed at the other leg part of the U-shaped recess 41. The notch 42 and the window 43 are formed in positions forming an angle of 180° with respect to each other on the outer perimeter of the rotatable plate 40. The notch 42 is positioned on the side of the upper surface of the rotatable plate 40 while the window 43 is positioned on the side of the lower surface of the rotatable plate 40, and the positions are at different heights.

The rotatable plate 40 has a shaft part 44 that is to be inserted in the shaft hole 23 of the bearing 20 on the lower surface. Although not shown in FIG. 1, the shaft part 44 has a shaft hole 45 in which the driving part 13 of the rotationally-manipulated shaft 10 is inserted (see FIG. 4). On the side of the upper surface of the rotatable plate 40, the shaft part 44 also has a shaft hole 46 that has a larger diameter than the shaft hole 45 and is in communication with the shaft hole 45. An engaging key 47, which protrudes from one site toward the center of the shaft hole 46 and extends in the axial direction, is formed on the inner perimeter of the shaft hole 46. A protrusion part 48, which has a shape conforming to the shape of one of the flat surfaces 13*a* of the driving part 13 of the rotationally-manipulated shaft 10, is formed on the inner perimeter of the shaft hole 46 at a site opposite to the engaging key 47. The shaft hole 46 has a diameter large enough to insert a rotary shaft 91 of the rotor 90 described later in the shaft hole 46.

The spring 50 has a U shape and is formed by bending a metal plate spring material having a small width into a U shape in this example.

The click piece 60 has the shape of a short cylinder, and two click pieces 60 are used. The click pieces 60 are made of metal or resin.

The intermediate plate 70 has the same rectangular shape as the housing 30 and has a shaft hole 71 formed at the center thereof. The shaft hole 71 has a diameter large enough to rotatably insert the rotary shaft 91 of the rotor 90 described later in the shaft hole 71. The intermediate plate 70 has two positioning holes 72*a* formed at adjacent sites along one side thereof, fixing holes 72*b* formed at a pair of diagonally opposite corners thereof, and positioning protrusions 73 formed on the lower surface at the other pair of diagonally opposite corners thereof. The intermediate plate 70 is made of resin, for example.

Figure 2A:
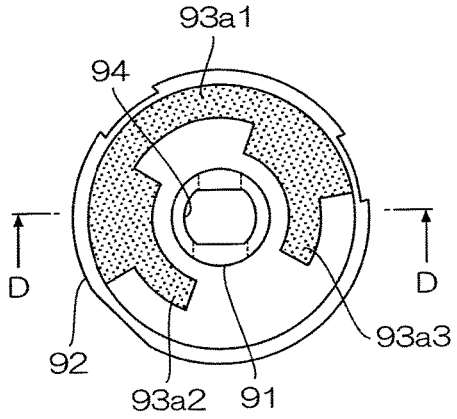
FIG. 2A is a plan view of a rotor shown in FIG. 1.
Figure 2B:
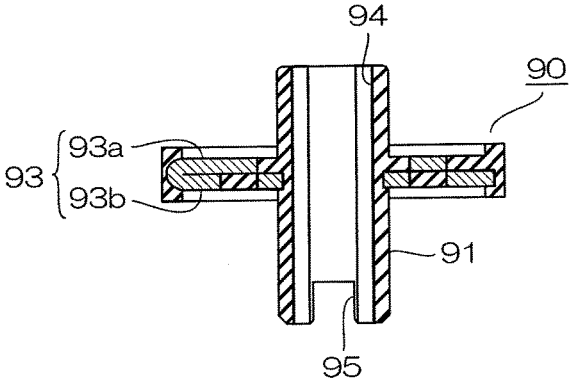
FIG. 2B is a cross-sectional view taken along the line D-D in FIG. 2A.
Figure 2C:
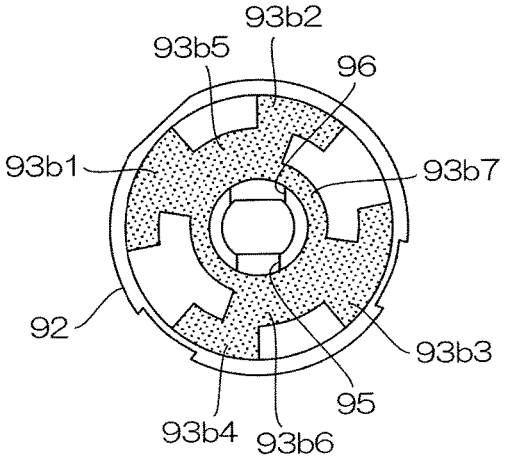
FIG. 2C is a bottom view of the rotor.

FIGS. 2A, 2B and 2C show the rotor 90 in detail. FIG. 2A is a plan view, FIG. 2B is a cross-sectional view taken along the line D-D in FIG. 2A, and FIG. 2C is a bottom view.

The rotor 90 comprises the rotary shaft 91, a disk part 92 located coaxially with the rotary shaft 91 at a middle point along the length of the rotary shaft 91, and a slidable contact piece 93 held in the disk part 92, which are integrally formed by insert molding. Note that the slidable contact piece 93 is shaded in FIGS. 2A and 2C.

The rotary shaft 91 has a shaft hole 94 that is to be engaged with the driving part 13 of the rotationally-manipulated shaft 10. The rotary shaft 91 also has, at the lower end thereof, notches 95 and 96 that are to be engaged with the engaging key 47 and the protrusion part 48 of the rotatable plate 40, respectively. The notches 95 and 96 have a predetermined length in the axial direction so that the rotary shaft 91 is inserted in the shaft hole 46 of the rotatable plate 40 over the length of the notches 95 and 96 in the axial direction.

The slidable contact piece 93 comprises an upper contact piece 93*a* and a lower contact piece 93*b*, which are formed by punching from one metal plate and bending as shown in FIG. 2B. The upper contact piece 93*a* and the lower contact piece 93*b* are overlaid one on another.

As shown in FIG. 2A, the upper contact piece 93*a* has two adjacent concentric annular regions, each of which includes an arc-shaped contact region (exposed region). In the outer annular region, one contact region 93*a*1 extending over a predetermined angular range is formed. In the inner annular region, two contact regions 93*a*2 and 93*a*3 each extending over a predetermined angular range are formed.

On the other hand, as shown in FIG. 2C, the lower contact piece 93*b* has two annular regions which are the same as (that is, which have the same diameters as) the two annular regions of the upper contact piece 93*a* and an annular region adjacent to the two annular regions on the inner side thereof. In the outermost annular region, four contact regions 93*b*1, 93*b*2, 93*b*3, and 93*b*4 each extending over a predetermined angular range are formed. In the intermediate annular region, two contact regions 93*b*5 and 93*b*6 each extending over a predetermined angular range are formed. In the innermost annular region, an annular contact region 93*b*7 (extending over 360°) is formed.

Figure 3A:
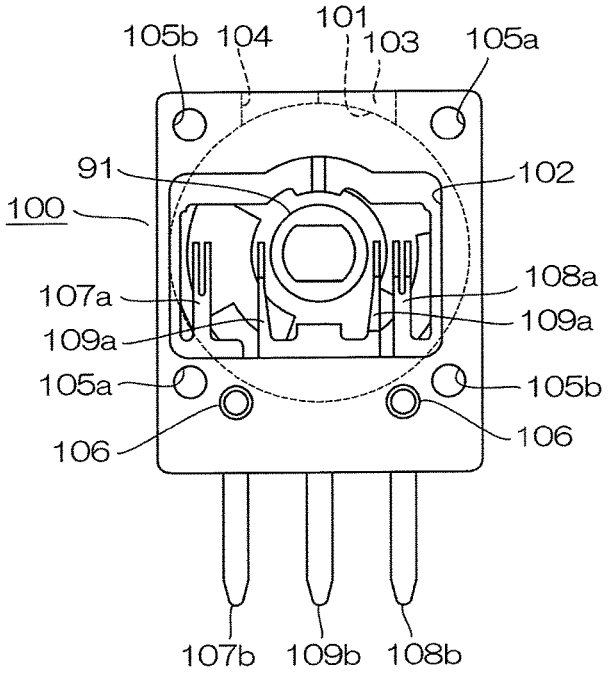
FIG. 3A is a plan view of an upper contact element holder shown in FIG. 1 and the rotor positioned under the upper contact element holder.

FIG. 3A shows the upper surface of the upper contact element holder 100 and the upper surface of the rotor 90 assembled and positioned under it.

The upper contact element holder 100 having the same rectangular shape as the housing part 30 has a circular rotor housing recess 101 in the lower surface thereof, and a substantially rectangular window 102 is formed in the top of the rotor housing recess 101. The upper contact element holder 100 also has an engaging protrusion 103 on and an engaging recess 104 in a side wall part of the rotor housing recess 101, which is adjacent to one side of the upper contact element holder 100. The engaging protrusion 103 is formed so as to project from the bottom of the side wall toward the lower contact element holder 80, and the engaging recess 104 is formed by cutting away a portion of the side wall part and adjacent to the engaging protrusion 103 so as to have the same width as the engaging protrusion 103. Positioning holes 105*a* are formed in the upper contact element holder 100 at a pair of diagonally opposite corners, and fixing holes 105*b* are formed at the other pair of diagonally opposite corners. Furthermore, two positioning protrusions 106 are formed at sites close to a side of the upper contact element holder 100 from which terminals 107*b*, 108*b*, and 109*b* are drawn to the outside.

The upper contact element holder 100 is formed by insert molding with three contact elements 107*a*, 108*a*, and 109*a* and the terminals 107*b*, 108*b*, and 109*b*, which integrally extend from the three contact elements 107*a*, 108*a*, and 109*a*, respectively, and project from the one side of the upper contact element holder 100 to the outside. The three contact elements 107*a*, 108*a*, and 109*a* extend inwardly from the edge of the window 102, and the tip ends thereof are located over the three annular regions defined on the slidable contact piece 93 of the rotor 90. In this example, each contact element 107*a*, 108*a*, 109*a* has two branch arms and is in contact with the corresponding annular region at two points and thus is improved in contact stability (reliability) and life time.

Figure 3B:
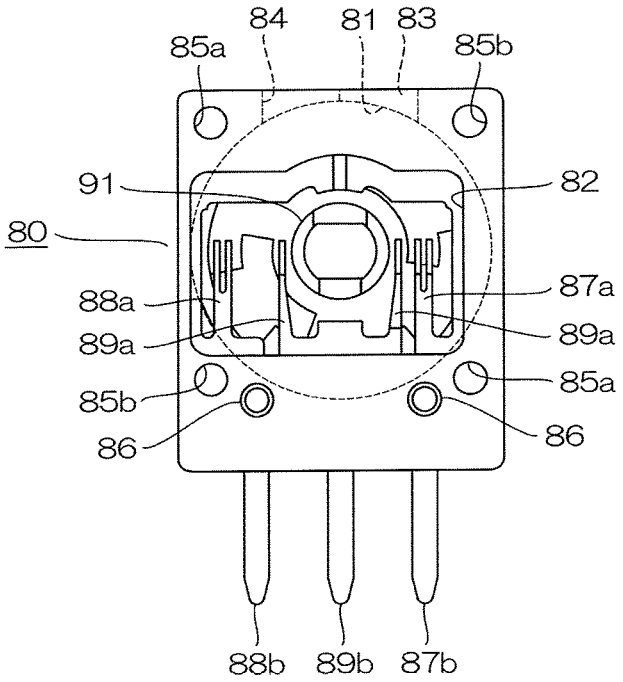
FIG. 3B is a bottom view of a lower contact element holder shown in FIG. 1 and the rotor positioned on the lower contact element holder.

FIG. 3B shows the lower surface of the lower contact element holder 80 and the lower surface of the rotor 90 assembled and positioned on it.

The lower contact element holder 80 has the same structure as the upper contact element holder 100. Thus, one contact element holder can be used as the upper contact element holder 100 or the lower contact element holder 80 by turning the contact element holder upside down.

The lower contact element holder 80 has a circular rotor housing recess 81 in the upper surface thereof, and a substantially rectangular window 82 is formed in the bottom of the rotor housing recess 81. The lower contact element holder 80 also has an engaging protrusion 83 on and an engaging recess 84 in a side wall part of the rotor housing recess 81, which is adjacent to one side of the lower contact element holder 80. The engaging protrusion 83 is formed so as to project from the bottom of the side wall toward the upper contact element holder 100, and the engaging recess 84 is formed by cutting away a portion of the side wall part and adjacent to the engaging protrusion 83 so as to have the same width as the engaging protrusion 83. Positioning holes 85*a* are formed in the lower contact element holder 80 at a pair of diagonally opposite corners, and fixing holes 85*b* are formed at the other pair of diagonally opposite corners. Furthermore, two positioning protrusions 86 are formed at sites close to a side of the lower contact element holder 80 from which terminals 87*b*, 88*b*, and 89*b* are drawn to the outside.

The lower contact element holder 80 is formed by insert molding with three contact elements 87*a*, 88*a*, and 89*a* and the terminals 87*b*, 88*b*, and 89*b*, which integrally extend from the three contact elements 87*a*, 88*a*, and 89*a*, respectively, and project from the one side of the lower contact element holder 80 to the outside. The three contact elements 87*a*, 88*a*, and 89*a* extend inwardly from the edge of the window 82, and the tip ends thereof are located over the three annular regions defined on the slidable contact piece 93 of the rotor 90. Each contact element 87*a*, 88*a*, 89*a* has two branch arms and is in contact with the corresponding annular region at two points.

The cover 110 has the same shape as the intermediate plate 70 and has a shaft hole 111, two positioning holes 112*a*, two fixing holes 112*b*, and two positioning protrusions 113 as with the intermediate plate 70. The cover 110 is made of resin, for example.

The parts are assembled as described below.

The rotationally-manipulated shaft 10 is inserted in the bearing 20, and the ring 29 is fitted in the annular groove 12*a* formed at the tip end part of the holding part 12 to prevent the rotationally-manipulated shaft 10 from dropping off.

The housing 30 is mounted on the flange 22 of the bearing 20. At the same time, the positioning protrusions 26 and 27 of the flange 22 are fitted in the positioning holes 35 and 36 of the housing 30, and the engaging protrusion 37 of the housing 30 is fitted in the engaging recess 25 of the flange 22.

The rotatable plate 40 is housed in the opening 31 of the housing 30 and the recess 24 of the bearing 20 following the opening 31 with the driving part 13 of the rotationally-manipulated shaft 10 inserted in the shaft hole 45 of the shaft part 44 and the shaft hole 46 in communication with the shaft hole 45. In this state, the two click pieces 60 are placed in the notch 42 and the window 43 of the rotatable plate 40. Then, the spring 50 is housed and placed in the recess 41 of the rotatable plate 40. The spring 50 can be easily fitted in the recess 41 by holding the spring 50 at the opposite ends with a pair of tweezers, for example, to narrow the U shape. The click pieces 60 may be placed in the notch 42 after the spring 50 is fitted in the recess 41. The two click pieces 60 are held between the spring 50 and the inner perimeter of the opening 31 of the housing 30.

The intermediate plate 70 is attached to the upper surface of the housing 30 to cover the top of the opening 31 of the housing 30 housing the rotatable plate 40 with the driving part 13 inserted in the shaft hole 71. At the same time, the positioning protrusions 73 of the intermediate plate 70 are fitted in the positioning holes 34*a* of the housing 30.

The positioning protrusions 86 of the lower contact element holder 80 are fitted in the positioning holes 72*a* of the intermediate plate 70, thereby positioning and fixing the lower contact element holder 80 on the intermediate plate 70. Then, from above, the lower end part of the rotary shaft 91 is inserted in and engaged with the shaft hole 45 of the rotatable plate 40 through the shaft hole 71 of the intermediate plate 70 while inserting the driving part 13 of the rotationally-manipulated shaft 10 in the shaft hole 94 of the rotor 90 so that substantially the lower half of the disk part 92 of the rotor 90 is placed in the rotor housing recess 81 of the lower contact element holder 80.

Then, the upper contact element holder 100 is placed and fixed on the lower contact element holder 80 to cover the rotor 90 from above so that substantially the upper half of the disk part 92 of the rotor 90 is housed in the rotor housing recess 101 of the upper contact element holder 100. In this process, the engaging protrusion 103 and the engaging recess 104 of the upper contact element holder 100 are engaged with the engaging recess 84 and the engaging protrusion 83 of the lower contact element holder 80, respectively, and positioned with respect to each other.

Then, the cover 110 is overlaid on the upper contact element holder 100 by inserting the upper end part of the rotary shaft 91 of the rotor 90 in the shaft hole 111 of the cover 110 and fitting the positioning protrusions 113 in the positioning holes 105*a* and the positioning protrusions 106 in the positioning holes 112*a*. In this way, the contact elements 87*a*, 88*a*, and 89*a* of the lower contact element holder 80 come into resilient contact with the lower surface of the disk part 92 of the rotor 90, and the contact elements 107*a*, 108*a*, and 109*a* of the upper contact element holder 100 come into resilient contact with the upper surface of the disk part 92 of the rotor 90.

With the parts assembled in this way, the two rivets 120 are inserted in the fixing holes 112*b* of the cover 110, the fixing holes 105*b* of the upper contact element holder 100, the fixing holes 85*b* of the lower contact element holder 80, the fixing holes 72*b* of the intermediate plate 70, the fixing holes 34*b* of the housing 30, and the fixing holes 28 of the bearing 20, and the tip ends of the rivets 120 are crimped, thereby integrating the parts and fixing them to each other to complete the switch.

In the switch arranged as described above, in response to rotation of the rotationally-manipulated shaft 10, the rotatable plate 40 and the rotor 90 integrally rotate, and the upper contact piece 93*a* and the lower contact piece 93*b* of the rotor 90 are connected to or disconnected from the contact elements 107*a*, 108*a*, and 109*a* of the upper contact element holder 100 and the contact elements 87*a*, 88*a*, and 89*a* of the lower contact element holder 80 depending on the angle of the rotation to produce a required switch open/close signal.

Figure 4A:
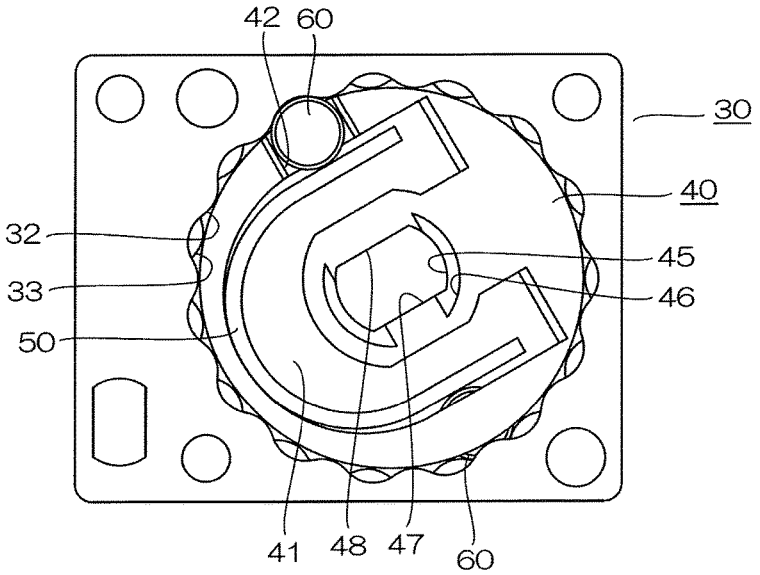
FIG. 4A is a plan view of the click mechanism shown in FIG. 1.
Figure 4B:
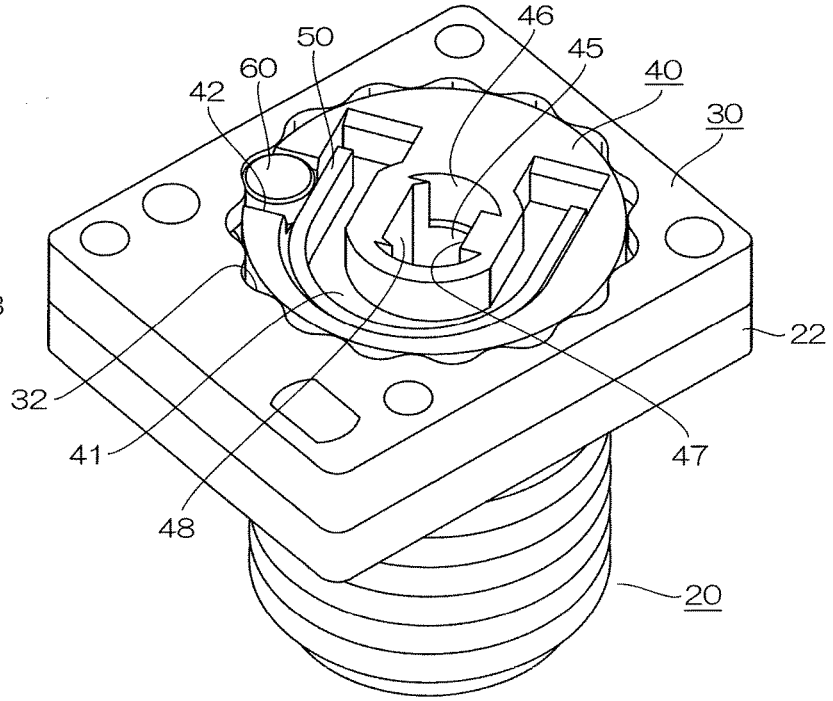
FIG. 4B is a perspective view of the click mechanism.

The two click pieces 60 that are positioned in the notch 42 and the window 43 in the outer perimeter of the rotatable plate 40 and retractably protrude from positions at different heights on the outer perimeter in the axial direction of the rotationally-manipulated shaft 10 are biased in the opposite directions by the leg parts of the U-shaped spring 50, and are pressed against and in resilient contact with, at the perimeters thereof, the upper-tier projections and depressions 32 and the lower-tier projections and depressions 33 formed on the inner perimeter of the opening 31 of the housing 30. This arrangement is shown in FIGS. 4A and 4B, in which illustration of the rotationally-manipulated shaft 10 is omitted.

In the following, a click mechanism of this switch will be described with reference to FIGS. 4A and 4B.

When the rotatable plate 40 rotates as the rotationally-manipulated shaft 10 rotates, the two click pieces 60 also rotate with the rotatable plate 40. At this time, one click piece 60 moves along the upper-tier projections and depression 32 formed on the inner perimeter of the opening 31 of the housing 30, and the other click piece 60 moves along the lower-tier projections and depressions 33 formed on the inner perimeter of the opening 31. The click pieces 60 alternately project from and are retracted into the rotatable plate 40, thereby producing a click feel.

Figure 10:
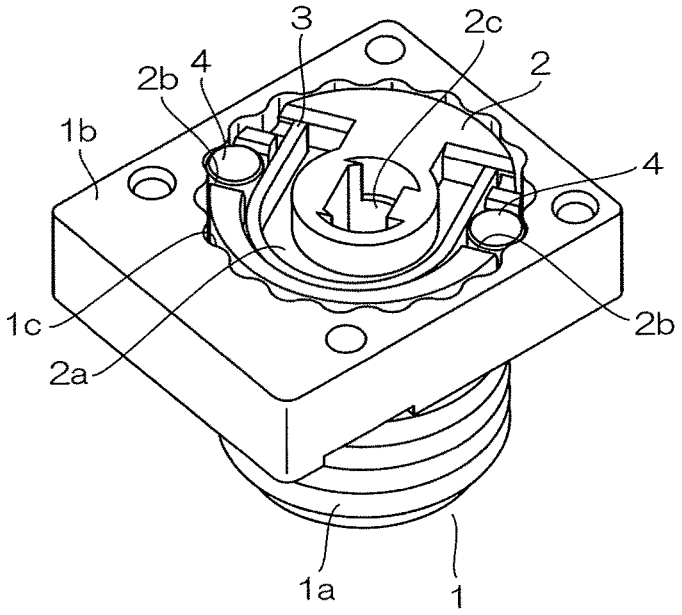
FIG. 10 is a diagram for illustrating an example of an arrangement of a conventional click mechanism.

As described above, in this example, the two click pieces 60 slide on the different projections and depressions 32 and 33. Therefore, unlike the example of prior art shown in FIG. 10 in which two click pieces slide on the same projections and depressions (on the same line), there is no constraint that the number of clicks (production of a click feel) in 360° rotation is limited to an even number, and the number of clicks can be freely set. In the example described above, both the upper-tier projections and depressions 32 and the lower-tier projections and depressions 33 have 15 protrusions formed with a predetermined pitch along a circle of the inner perimeter of the opening 31 of the housing 30, that is, 15 repetitions of the projections and depressions are arranged and formed. Thus, the number of clicks in 360° rotation can be 15.

Figure 5A:
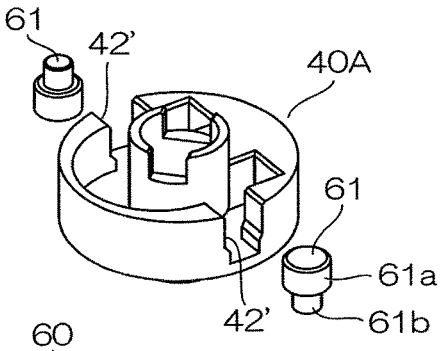
FIGS. 5A and 5B are perspective views showing other examples of arrangements of a rotatable plate and a click piece.
Figure 5B:
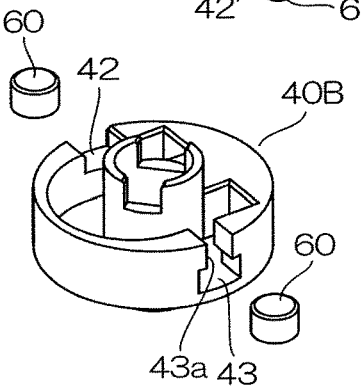

FIGS. 5A and 5B show other examples of the shapes of a rotatable plate and a click piece. In FIG. 5A, two click pieces 61 are stepped cylindrical, each including a large-diameter part 61*a* and a small-diameter part 61*b*. Notches 42' that conforms to the shape of the click piece 61 are formed in positions forming an angle of 180° with respect to each other on the outer perimeter of a rotatable plate 40A so that the click pieces 61 can be housed and placed in the notches 42'. The two click pieces 61 are placed with one turned upside down with respect to the other, and the large-diameter parts 61*a* come into resilient contact with the projections and depressions 32 and 33 of the housing 30. The rotatable plate 40B shown in FIG. 5B differs from the rotatable plate 40 shown in FIG. 1 in that a notch 43*a* that extends to the upper surface of the rotatable plate 40B is added above the portion in which the window 43 is formed.

Figure 6A:
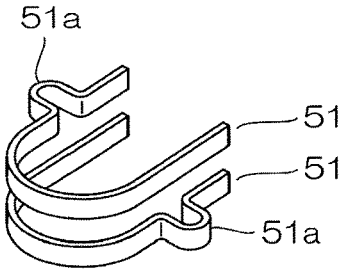
FIGS. 6A to 6C are perspective views showing examples of the shapes of a spring provided with a protrusion.
Figure 6B:
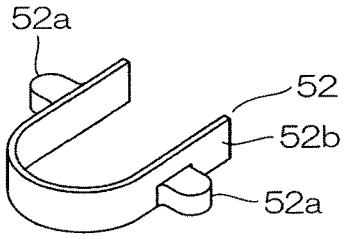
Figure 6C:
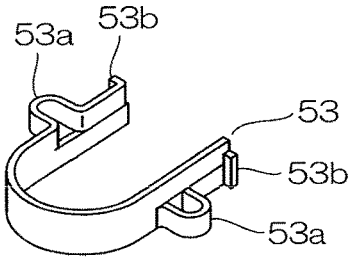

In the examples described above, the two click pieces and the spring by which the click pieces are biased in the opposite directions are separately formed. However, protrusions may be integrally formed with a spring and in resilient contact with the projections and depressions 32 and 33 formed in the housing 30, thereby eliminating the use of click pieces. FIGS. 6A to 6C show various arrangement examples of springs with which protrusions are thus integrally formed.

FIG. 6A shows an example in which two U-shaped springs 51 are used, with a protrusion being integrally formed with each of the springs 51. A protrusion 51*a* is integrally formed with the U-shaped spring 51 at one leg part and projects outwardly. The spring 51 has a width substantially half the width of the spring 50 shown in FIG. 1 and is formed by bending a metal plate spring material, and the protrusion 51*a* is formed by bending the spring 51 into a U shape. The two springs 51 are overlaid one on another in two upper and lower tiers in the recess 41 of the rotatable plate 40. At this time, the two springs 51 are overlaid one on another so that the protrusions 51*a* are positioned in the opposite sides of the leg parts of the U-shaped springs 51.

The protrusions 51*a* of the two springs 51 are positioned in the notch 42 and the window 43 in the outer perimeter of the rotatable plate 40 and project from the outer perimeter to come into resilient contact with the projections and depressions 32 and 33 in the two upper and lower tiers of the housing 30. In this example, the protrusions 51*a* integrally formed with the springs 51 move along the projections and depressions 32 and 33, and alternately project from and are retracted into the rotatable plate 40, thereby producing a click feel.

FIG. 6B shows an example in which protrusions that come into resilient contact with the projections and depressions 32 and 33 of the housing 30 are made of resin. In this example, a protrusion 52*a* is integrally formed with a U-shaped plate spring 52*b*. The two protrusions 52*a* are formed in positions at different heights in the vertical direction (in the width direction of the plate spring 52*b*). The tip surfaces of the protrusions 52*a*, which come into resilient contact with the projections and depressions 32 and 33 of the housing 30, are semicylinder surfaces.

FIG. 6C shows an example in which one U-shaped spring 53 has two protrusions 53*a* formed therein by bending the U-shaped spring 53. In this example, each of the leg parts of the U-shaped spring 53 is cut and divided into halves, and the protrusion 53*a* is formed in one half by bending into a U shape. As shown in FIG. 6C, one protrusion 53*a* is formed in the upper half of one leg part divided into halves in the width direction, and the other protrusion 53*a* is formed in the lower half of the other leg part divided into halves in the width direction. In this example, the tip of one half of each leg part in which the protrusion 53*a* is formed has a widened bend part 53*b* formed therein extending to the other half, thereby enabling the effective use of resilient biasing force of the spring 53.

Figure 7A:
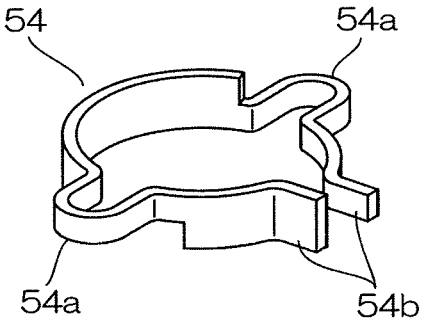
FIGS. 7A to 7C are perspective views showing other examples of the shapes of the spring provided with the protrusion.

Although all springs in the examples described above are U-shaped, a spring is not limited to the U shape and may have a shape shown in any of FIGS. 7A to 7D. A spring 54 shown in FIG. 7A is made of a metal plate spring material and has a ring shape with an opening. Protrusions 54*a* that are to come into resilient contact with the projection and depressions 32 and 33 of the housing 30 are formed outwardly with respect to each other in the halves on the opposite sides of the opening. As shown in FIG. 7A, the portion in which one protrusion 54*a* is formed is notched in the lower half in the width direction and narrowed, and the portion in which the other protrusion 54*a* is formed is notched in the upper half in the width direction and narrowed. Thus, the two protrusions 54*a* are positioned at different heights in the width direction of the spring 54 (in the vertical direction).

Figure 7B:
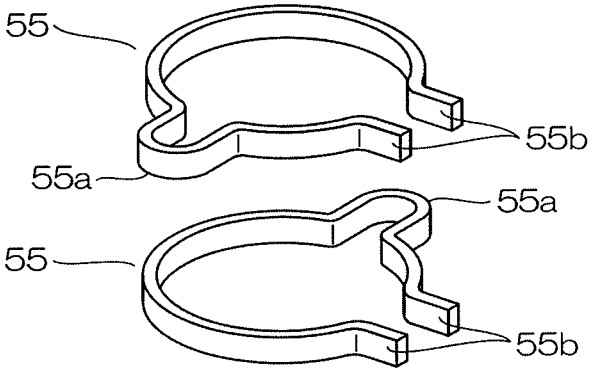

As with the springs 51 shown in FIG. 6A above, two springs 55 shown in FIG. 7B are overlaid one on another. The springs 55 differ from the springs 51 shown in FIG. 6A in that each of the springs 55 has a ring shape with an opening as in FIG. 7A. The two springs 55 are overlaid one on another so that the protrusions 55*a* are positioned in the opposite sides of the ring.

Figure 7C:
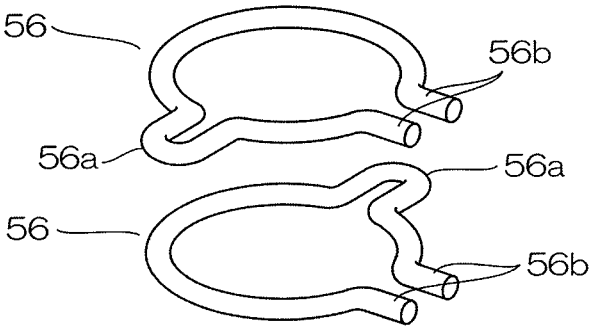

Springs 56 shown in FIG. 7C are made of a line material rather than a plate material and formed by bending the line material into a ring shape, and protrusions 56*a* are integrally formed with the springs 56 by bending the springs 56, as with the springs 55 shown in FIG. 7B.

Figure 7D:
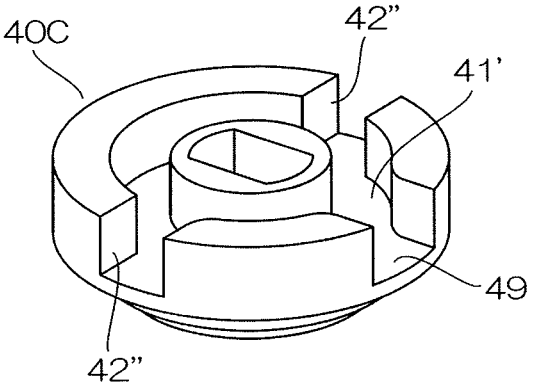
FIG. 7D is a perspective view showing the shape of the rotatable plate suitable for the springs shown in FIGS. 7A to 7C.

FIG. 7D shows a shape of a rotatable plate 40C in which any of the ring-shaped springs with an opening shown in FIGS. 7A to 7C is housed and placed. In this example, the rotatable plate 40C has an annular recess 41' for housing the springs and two notches 42" in which the protrusions of the springs are housed and positioned. The rotatable plate 40C also has a notch 49 that is in communication with the recess 41' and extends to the outer perimeter of the rotatable plate 40C.

The ring-shaped springs 54 to 56 with an opening have extension parts 54*b*, 55*b*, 56*b* protruding outwardly at the opening, and the notch 49 houses the extension part 54*b*, 55*b*, or 56*b*. In assembly of the spring 54 (55, 56) to the rotatable plate 40C, the spring 54 (55, 56) can be easily fitted into the recess 41' by holding the pair of extension parts 54*b* (55*b*, 56*b*) with a pair of tweezers or the like to narrow the ring. In this process, the notch 49 serves as an escape for the tweezers.

As described above, an arrangement with click pieces and a spring may be replaced with a spring or springs with which protrusions that come into resilient contact with the projections and depressions 32 and 33 of the housing 30 are integrally formed. At this time, one spring may be used or two springs may be overlaid one on another. The protrusions may be formed by bending the springs or may be made of resin and integrally formed with the springs. Furthermore, the springs are not limited to the U shape and may have a ring shape with an opening. In addition, the springs are not limited to a plate material and may be made of a line material.

Figure 8:
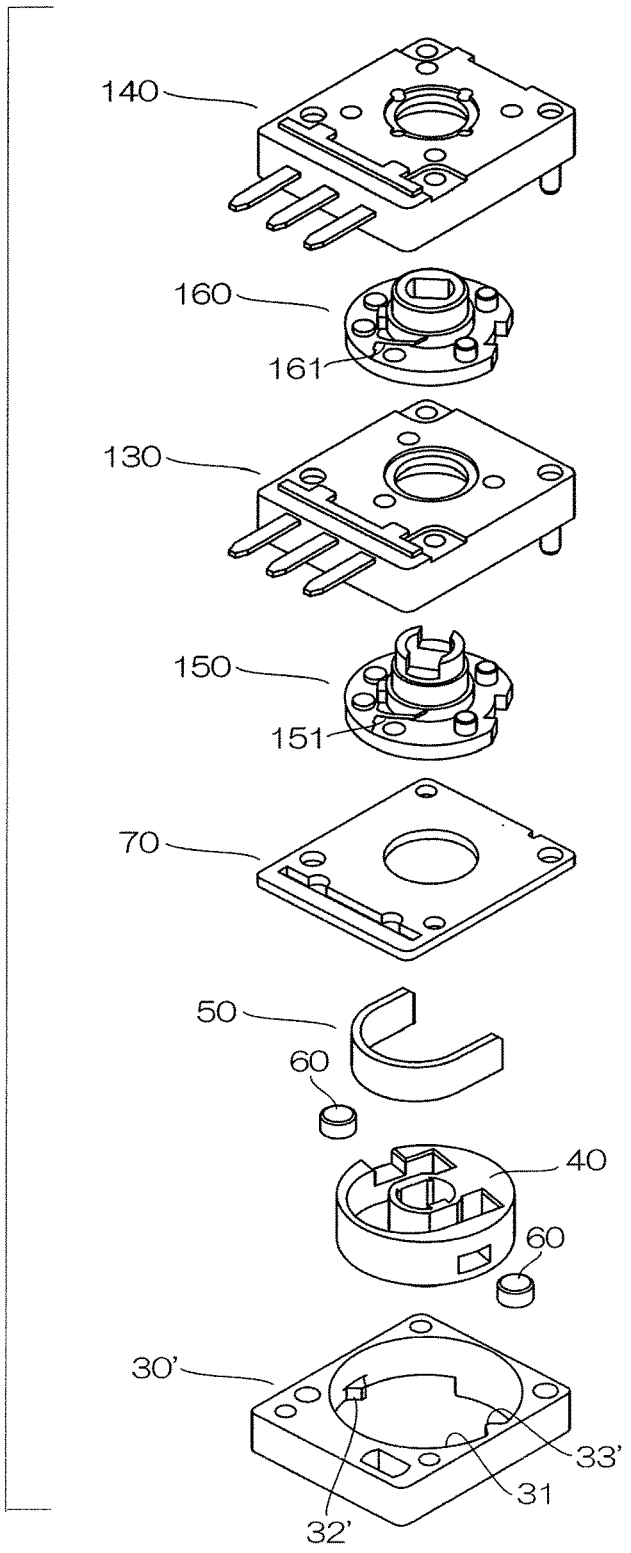
FIG. 8 is an exploded perspective view of main parts of a variable resistor having a switch provided with a click mechanism according to another embodiment of the present invention.

Next, a click mechanism according to another embodiment of the present invention shown in FIG. 8 will be described.

In this embodiment, the click mechanism is disposed in a variable resistor having a switch. FIG. 8 shows only an arrangement of main parts, and the rotationally-manipulated shaft 10, the bearing 20, the ring 29, and the rivets 120 to be used, which are not shown in FIG. 8, are the same as those shown in FIG. 1. In this embodiment, the spring 50 and the two click pieces 60 are housed and placed in the rotatable plate 40 as in FIG. 1.

Figure 9A:
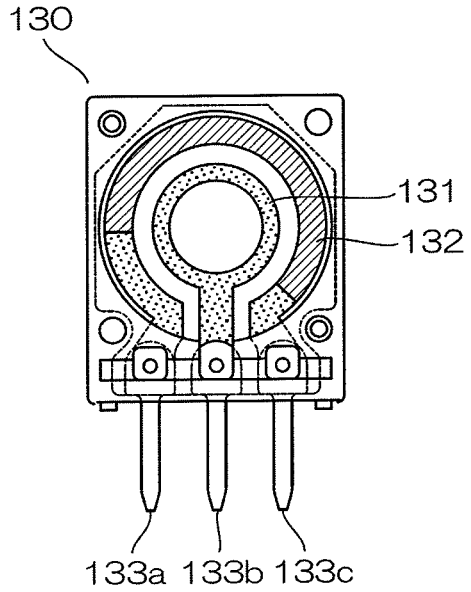
FIG. 9A is a plan view of a lower case shown in FIG. 8.

In this embodiment, the click mechanism is provided with a lower case 130, an upper case 140, a lower rotor 150, and an upper rotor 160. As shown in FIG. 9A, a current collector pattern 131 and a resistor pattern 132 are formed in the lower case 130 as patterns for the variable resistor. The current collector pattern 131 is annular, and the resistor pattern 132 is arc-shaped and formed on the outside of the current collector pattern 131. In FIG. 9A, reference characters 133*a* to 133*c* denote terminals that are connected to these patterns and drawn to the outside.

Figure 9B:
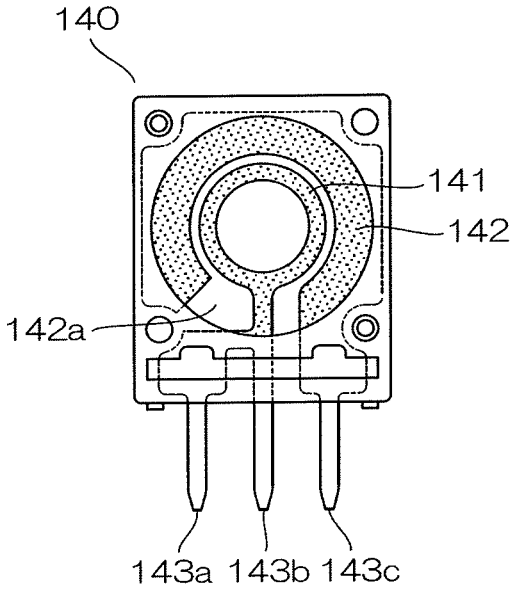
FIG. 9B is a plan view of an upper case shown in FIG. 8.

As shown in FIG. 9B, current collector patterns 141 and 142 are formed in the upper case 140 as patterns for the switch. The current collector pattern 141 is annular, and the current collector pattern 142 is annular and chipped and formed on the outside of the current collector pattern 141. The chipped portion of the current collector pattern 142 is an OFF part (OFF region) 142*a* of the switch. In FIG. 9B, reference characters 143*a* to 143*c* denote terminals that are connected to these patterns and drawn to the outside.

Sliders 151 and 161 are attached to the lower rotor 150 and the upper rotor 160, respectively. The slider 151 is in sliding contact with the patterns for the variable resistor in the lower case 130, and the slider 161 is in sliding contact with the patterns for the switch in the upper case 140. In this embodiment, rotation of the rotationally-manipulated shaft 10 produces a required switch open/close signal (ON/OFF signal) and an output of a changed resistance value. Then, a click feel is produced upon open/close manipulation of the switch, that is, one click feel is produced in 360° rotation.

To enable the number of clicks in 360° rotation to be 1, a projection of a projection and depression is disposed in a site on the inner perimeter of the opening 31 of a housing 30'. An upper-tier projection 32' and a lower-tier projection 33' are disposed in positions forming an angle of 180° with respect to each other.

Thus, according to this embodiment, the number of clicks in 360° rotation can be 1, which has not conventionally been possible.

What is claimed is:

1. A click mechanism for an electric part that has a rotationally-manipulated shaft, comprising:

a spring that is made of a plate material and disposed on a rotatable plate that rotates integrally with said rotationally-manipulated shaft;

two cylindrical click pieces disposed on an outer perimeter of said rotatable plate in positions forming an angle of 180° with respect to each other so as to retractably protrude from the positions at different heights on the outer perimeter in an axial direction of said rotationally-manipulated shaft; and projections and depressions formed on an inner perimeter of a housing for said rotatable plate in a circumferential direction, in two upper and lower tiers in the axial direction, wherein said projections and depressions in the two upper and lower tiers are the same size and staggered in the circumferential direction, said two click pieces are biased by said spring to be in resilient contact with said projections and depressions in the two upper and lower tiers at perimeters thereof, and one of said two click pieces is always in the upper-tier and the other one of said two click pieces is always in the lower-tier.

2. The click mechanism for an electric part according to claim 1, wherein said spring has a U shape, and the leg parts of the U-shaped spring bias said two click pieces in the opposite directions.

3. The click mechanism for an electric part according to claim 1, wherein said spring has a ring shape with an opening, and the halves on the opposite sides of the opening bias said two click pieces in the opposite directions.

* * * * *